US008089330B2

(12) United States Patent
Wen et al.

(10) Patent No.: US 8,089,330 B2
(45) Date of Patent: Jan. 3, 2012

(54) SATURATED REACTOR OF DIRECT CURRENT THYRISTOR VALVE

(75) Inventors: Jialiang Wen, Beijing (CN); Xiaoguang Wei, Beijing (CN); Haiyu Yu, Beijing (CN); Sheng Zhang, Beijing (CN)

(73) Assignee: China Electric Power Research Institute, Beijing (CN)

( * ) Notice: Subject to any disclaimer, the term of this patent is extended or adjusted under 35 U.S.C. 154(b) by 124 days.

(21) Appl. No.: 12/679,299

(22) PCT Filed: Dec. 18, 2009

(86) PCT No.: PCT/CN2009/001508

§ 371 (c)(1), (2), (4) Date: Mar. 19, 2010

(87) PCT Pub. No.: WO2011/063556

PCT Pub. Date: Jun. 3, 2011

(65) Prior Publication Data

US 2011/0175697 A1 Jul. 21, 2011

(30) Foreign Application Priority Data

Nov. 27, 2009 (CN) ..... 2009 1 0238198

(51) Int. Cl.
*H01F 27/08* (2006.01)

(52) U.S. Cl. ..... 336/55

(58) Field of Classification Search ..... 336/65.83, 336/178, 55–62
See application file for complete search history.

(56) References Cited

U.S. PATENT DOCUMENTS 3,659,239 A * 4/1972 Marton ..... 336/57
4,012,706 A * 3/1977 Westendorp ..... 336/84 R
6,147,580 A * 11/2000 Rettew et al. ..... 336/60
7,893,804 B2 * 2/2011 Ahangar et al. ..... 336/60

* cited by examiner

*Primary Examiner* — Tuyen Nguyen
(74) *Attorney, Agent, or Firm* — Courtney IP Law; Barbara B Courtney

(57) ABSTRACT

The present invention provides a novel direct current thyristor valve saturated reactor includes: case, winding in the case, iron cores, cooling fins, pipes and press fit mechanism. The iron cores are coupled with winding. The invention having the following advantages: simple, modular design, low connection capacity of the wingding, fixed dimension, winding and irons well-cooled, small noise and vibration. The saturated reactor is particularly suitable used as the positive saturated reactor for high voltage current thyristor valve.

8 Claims, 4 Drawing Sheets

SATURATED REACTOR OF DIRECT CURRENT THYRISTOR VALVE

RELATED APPLICATIONS

This Application is a United States National Stage Application file under 35 U.S.C. §371 of PCT Patent Application Serial No. PCT/CN2009/001508 filed on Dec. 18, 2009, which claims the benefit of Chinese Patent Application Serial No. 2006910238498.4 filed on Nov. 27, 2009, the disclosures of all of which are hereby incorporated by reference in their entirety.

FIELD OF THE INVENTION

The present invention relates to power element field, and particularly relates to a novel saturated reactor of direct current thyristor valve.

BACKGROUND OF THE INVENTION

Now there are several arts of the saturated reactor of the direct current thyristor valve which is applied for high voltage direct current transmission.

First, the saturated reactor is constituted of a couple of irons core and cycles of wingding. Because there is only one couple of irons core, the parameters of the cores is adjusted by controlling the number of the irons, besides the inductance of reactor is controlled by the cycle number of the wingding together with the irons. What's more, the iron cores and the wingding adopt their cooling water system respectively. This saturated reactor suffers from the following disadvantages: large size, complex structure of its cooling water circuit.

Second, fix the cycle number of the wingding, change the couple of the irons, and put the wingding coupled with irons into top and bottom covers to form modular design. This design is not helpful for the irons cooling. To satisfy the requirement, the lower losses iron core is needed; this increases the cost of the saturated reactor largely.

Third, fix the cycle number of wingding, change the couple number of the irons, and equip secondary water cooling winding. The irons and wingding adopt their cooling water system respectively; moreover they are exposed in the air. This design suffers from the following disadvantages: largely noise and vibration significantly. Further, to meet the requirement, a perfect press fit mechanism is needed, and this increase complexity of manufacturing process and cost largely.

SUMMARY OF THE INVENTION

Preferred embodiments of the present invention seek to overcome the above disadvantages of the prior devices and provide a simple, modular, low connection capacity of the wingding, fixed dimension, winding and irons having well cooling, small noise and vibration saturated reactor, particularly suitable used as the positive saturated reactor for high voltage current thyristor valve With this aim in view, the present utility resides in that a novel direct current thyristor valve saturated reactor includes case, winding in the case, iron cores, cooling fins, pipe and press fit mechanism, the iron cores are coupled with winding. Said the iron core looks like a word 'C' or 'U', two faced iron cores are fixed on the edge of winding, each two iron cores is fastened on the winding and form a closed cycle; there is air matting in the gaps between two iron core contacting, and the height of the air matting can adjust; the winding forms a track, there are couples of iron cores in the straight line parts of the track; the block terminal and are respectively located at two opposite directions of the winding. Said 'C' structure or 'U' iron cores is fixed by press fit mechanism; between two iron cores, there is a lower cooling fin and an upper cooling fin, the shape of the two cooling fin like a symbol 'Π', and each two cooling fin couples together and forms a closed cycle; there is a faucet on the surface of each cooling fin; and between two same height lower cooling fins and upper cooling fins, their faucets connect together through pipes; between two iron cores, and also two upper cooling fins, two lower cooling fins, there are rubber gaskets to isolate them; there are iron cramp bars between iron cores and upper cooling fins, lower cooling fins, to connect them.

Said case includes the top cover and below cover, they are connected together; there is polyurethane and/or earthquake resistant material and/or noise absorption material in the case; these materials and/or substances fix said winding, iron core, upper cooling fins, lower cooling fins and pipes.

Said winding form a track, and its inner is empty, itself likes a track pipe; may adopt epoxy resin to pouring the winding.

Said winding may coat insulating layer on the surface of the winding and then form the track structure, and needn't the epoxy resin to pouring the winding; the number and thickness of said insulating layer can both be adjusted according to the insulation requirement of the insulating layer.

The couple number of said iron core and the thickness of said air matting can be adjusted according to the actual parameters of the reactor.

The number of said upper cooling fins and lower cooling fins can be adjusted according to the actual parameters of the reactor.

The shape of said winding may also be orbicular, elliptical and/or other shapes which are suitable for the inner empty structure.

There are stainless steel faucets and pipe couplings on the both sides of said upper cooling fins and lower cooling fins; the faucet inside direction of the winding of upper cooling fins which is perpendicular to the line segment of the winding connect pipes, and the faced lower cooling fins are also connected with pipes.

There are some advantages of the present invention in the following:

1. The manufacturing process is simple and mature, because this invention fixes the cycle number of the wingding design, and adjusts the couple number of the iron cores according to different voltage and other parameters requirements of the saturated reactor. There is no need to changing the shape size of the winding and each couple of iron cores. There is no need a new design of it.

2. The water cooling system design is simple although both the iron cores and the wingding adopt their cooling water system respectively; there is no need to changing the shape size of the cooling fins, just adjusting the couple number of the iron cores according to the requirement; these cooling fins placed among the iron cores works very well, uniform heat cooling because of the cooling fins between couples of iron cores are parallel connected; this also meet the requirement of modular design.

3. This provides a low connection capacity of the wingding because the block terminals are located on the sides of the winding. This makes the cycle number of the iron core coupled with wending fractional amount, and it strengthens the adaptability of the cycle number.

4. The wending is poured with the epoxy resin or coated with insulating layer; and then the wending, cooling fins, pipes and press fit mechanism are all poured together with polyurethane. This strengthens the global stability. Further, there is earthquake resistant material and/or noise absorption material in the case, the polyurethane has resilience, all of these decrease the noise and vibration during the saturated reactor working.

BRIEF DESCRIPTION OF THE DRAWINGS

Currently preferred embodiments of the invention will now be described with reference to the following attached drawings in which.

1—top cover, 2—below cover, 3—winding, 4—block terminal I, 5—block terminal□, 6—iron core, 7—up cooling fin, 8—below cooling fin, 9—faucet, 10—pipe coupling, 11—pipe, 12—press fit mechanism, 13—air matting, 14—iron cramp bar, 15—rubber gasket, 16—pipe coupling of winding, 17—copper plate, 18—polyurethane, 19—aluminum pipe, 20—insulating layer;

DETAILED DESCRIPTION OF EMBODIMENTS

The detail of the embodiments is described as below incorporated with the figures by way of cross-reference.

Figure 1:
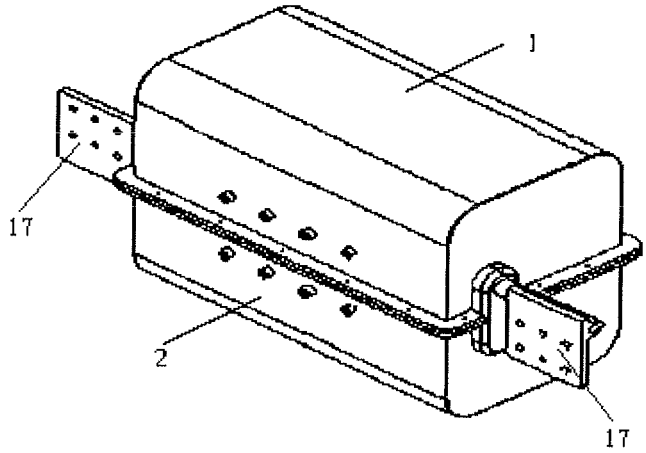
FIG. 1 is outside space structure schematic diagram of a saturated reactor, according to the present invention.
Figure 2:
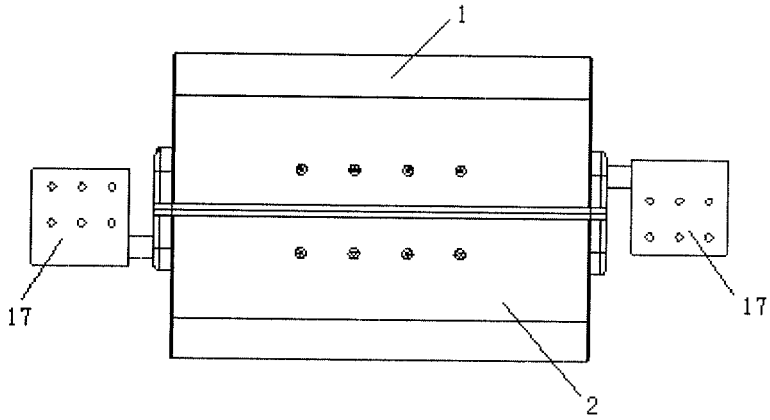
FIG. 2 is the front view of a saturated reactor, according to the present invention.
Figure 3:
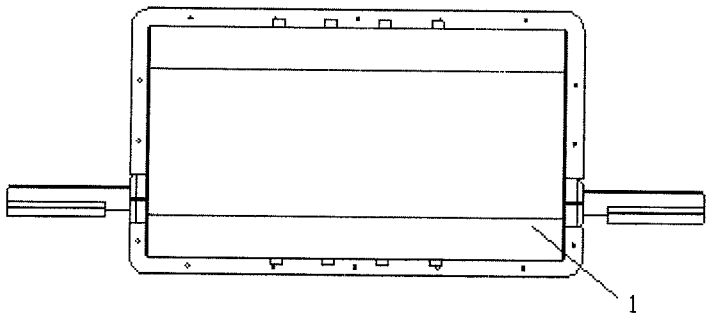
FIG. 3 is the top view of FIG. 2.
Figure 4:
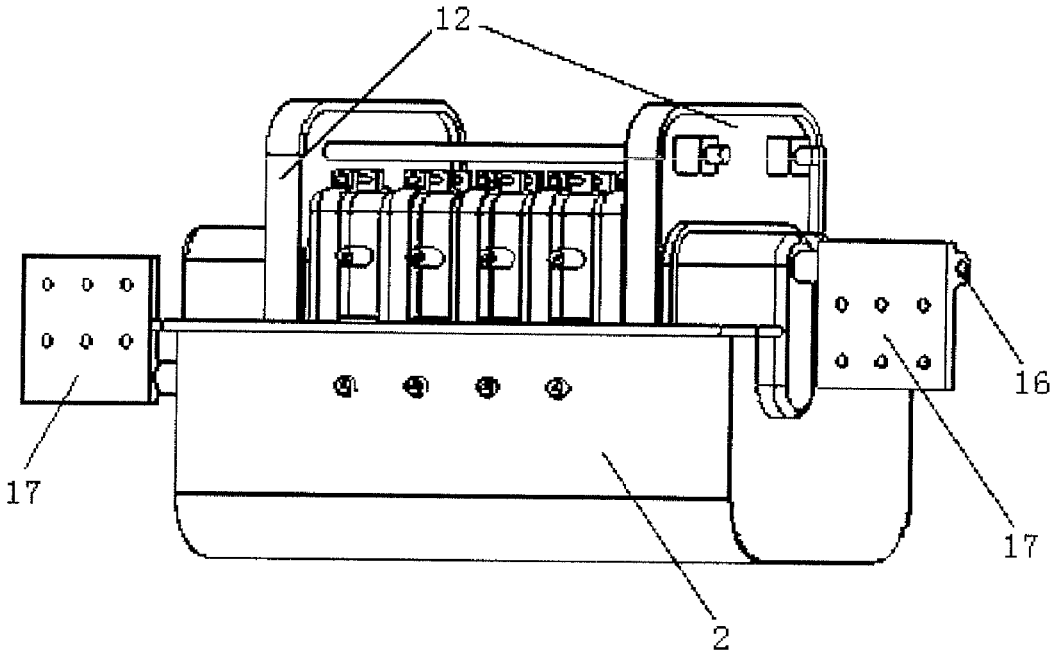
FIG. 4 is the space structure schematic diagram of a saturated reactor without the top cover, according to the present invention.
Figure 5:
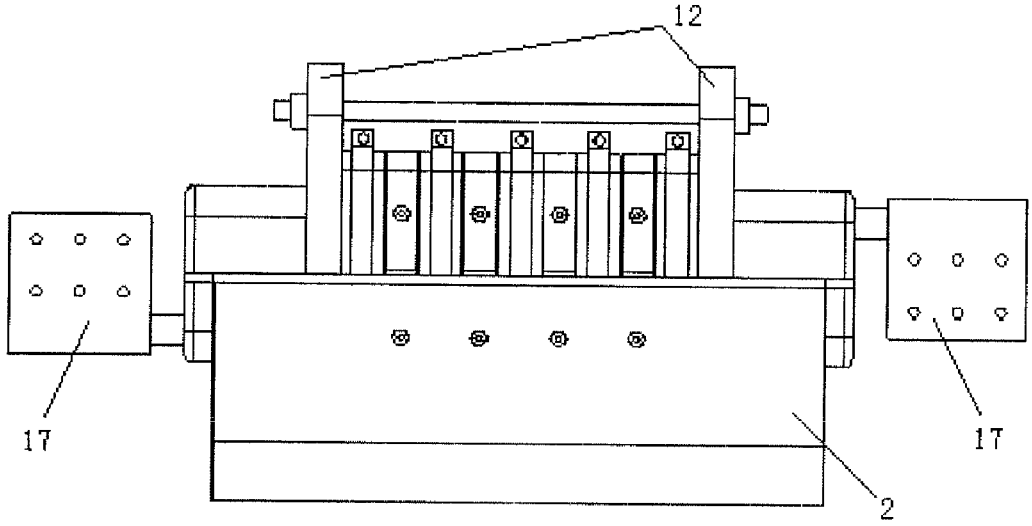
FIG. 5 is the front view of a saturated reactor without the top cover, according to the present invention.
Figure 6:
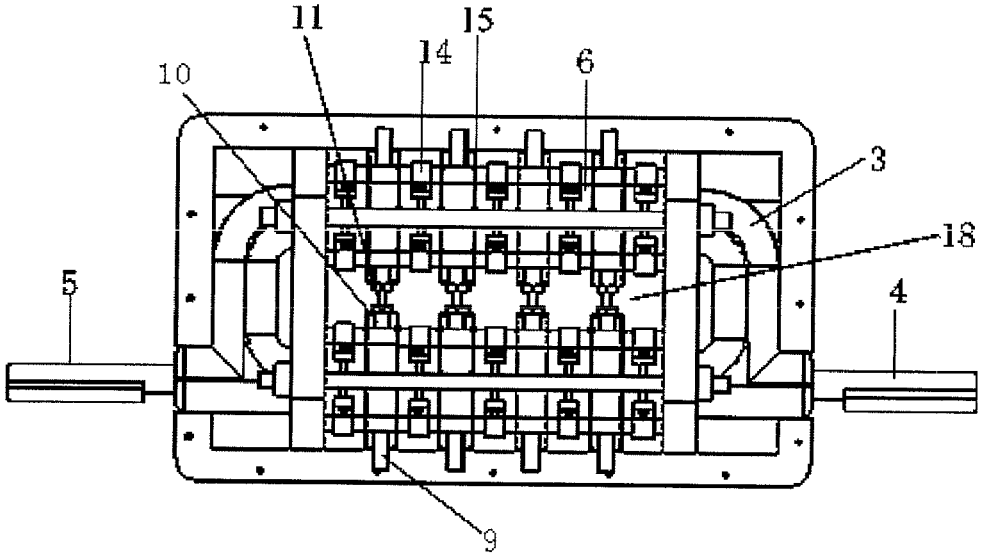
FIG. 6 is the top view of the FIG. 5.
Figure 7:
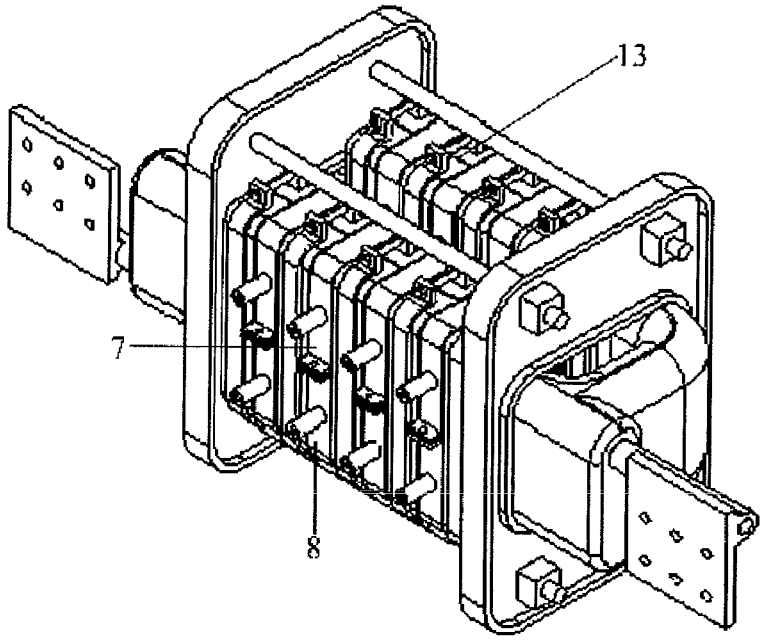
FIG. 7 the space structure schematic diagram of a saturated reactor without the top and below covers, according to the present invention.
Figure 8:
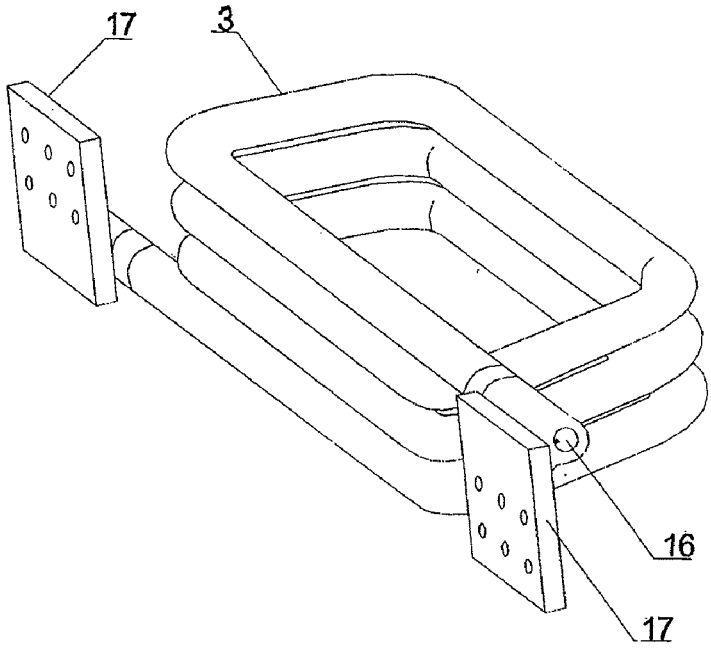
FIG. 8 are the schematic diagram of winding 3.
Figure 9:
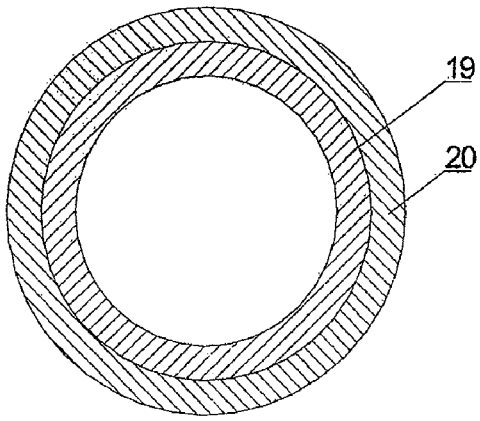
FIG. 9 is a section of another form of the winding 3: an insulating layer of the aluminum pipe, in these figures.

As FIG. 1-8 shown, a novel direct current thyristor valve saturated reactor includes the winding 3 located between top cover 1 and below cover 2, iron cores 6 coupled and fixed together with winding 3, the upper cooling fins 7 and the lower cooling fins 8. Two terminals of the winding 3 block terminal I 14 and block terminal II 15 are placed on the opposite directions of the winding 3 respectively. The winding 3 is made of aluminum pipe, its shape looks like a track. The block terminals I 14 and block terminals II 15 are all welded on the copper plates 17 which are used for linking the mother wires. Two end of the winding pipe are used for connecting pipe coupling of winding 16. The winding 3 is put into a mold and then is poured with epoxy resin, or the surface of the winding aluminum pipe 3 is coated with insulating layer 20. As FIG. 9 shown, the cooling layer can adopt different materials according to the requirement of the winding. The thickness and layer number of the insulating layer are also adjusted according to the insulating requirement.

Some couples of iron cores, which shapes like left and right word 'C' or upper and lower 'U', fasten on line parts of the winding 3 and form a closed cycle. There is an air matting 13 in the gap between two iron core 6 contacting places. The iron cores 6 fixed by the ion cramp bar 14, and each couple iron cores which is located at the line part of the winding 3 is separated by a rubber gasket. There is one upper cooling fin 7 and one lower cooling fin 8 between each couple iron cores 6 at least. The upper cooling fin 7 and the lower cooling fin 8 opposing connect together, and locate between the outside and inside of the winding 3. There is a rubber gasket 15 in the connecting place of the upper cooling fin 7 and the lower cooling fin 8 which is located the line part of the winding 3, and so are each couple iron cores 6 to isolate the iron cores 6 from the upper cooling fins 7 and the lower cooling fins 8 and also isolate the iron cores 6 and cooling fins.

There are stainless steel faucets 9 and pipe couplings 10 on the surface of the cooling fins both on outside and inside directions of the winding 3. The faucet 9 inside direction of the winding 3 of upper cooling fins 7 which is perpendicular to the line segment of the winding 3 connect pipes 11, and the faced lower cooling fins 8 are also connected with pipes 11.

At last, the iron cores 6, the upper cooling fins 7, the lower cooling fins 8 and the inside connecting pipe 11 are all put into a mold and poured with polyurethane 18, and then close the top cover 1 and the below cover 2 and cool down.

In this example of the present invention, the standard cycle number of the winding 3 is 4.5, the total couple number of the iron cores 6 can be adjusted according to the actual inductance requirement, and the thickness of the air matting 13 can be adjusted according to the actual design parameters of the reactor. The couple number of the upper cooling fin and lower cooling fin can be adjusted according to the actual heat produced by the iron cores 6. The number of the rubber 15 can be adjusted according to the actual number of the iron cores. The cycle number of the iron core coupled with wending is fractional amount, and this strengthens the adaptability of the cycle number. The block terminal I 14 and terminal II 15 are set the opposite direction of the winding 3.

At last, in this description of the embodiments, we have detail describe the present invention according to a particular example. The detail embodiment is one example of the invention but not the only one, so the person in this field must be understand that all the alternatives and other equal and/or similar examples are all within the range of the invention and they are all consistent with the spirit of this invention, are all protected by our claims.

The invention claimed is:

1. A novel direct current thyristor valve saturated reactor includes case, winding (3) in the case, iron cores (6), cooling fins, pipe (11) and press fit mechanism (12), the iron cores (6) are coupled with winding (3); the invention is characterized by:

said the iron core (6) looks like a word 'C' or 'U', two faced iron cores are fixed on the edge of winding (3), each two iron cores is fastened on the winding (3) and form a closed cycle; there is an air matting (13) in the gap between two iron core contacting, and the height of the air matting (13) can adjust;

the winding (3) forms a track, there are couples of iron cores (6) in the straight line parts of the track; the block terminal (4) and (5) are respectively located at two opposite directions of the winding (3);

said 'C' structure or 'U' iron cores (6) is fixed by press fit mechanism (12);

between two iron cores (6), there is a lower cooling fin (8) and an upper cooling fin (7), the shape of the two cooling fin like a symbol 'Π', and each two cooling fin couples together and forms a closed cycle; there is a faucet (7) on the surface of each cooling fin; and between two same height lower cooling fins (8) and upper cooling fins (7), their faucets (9) connect together through pipes (11);

between two iron cores (6), and also two upper cooling fins (7), two lower cooling fins (8), there are rubber gaskets (15) to isolate them;

there are iron cramp bars (14) between iron cores (6) and upper cooling fins (7), lower cooling fins (8), to connect them.

2. A novel direct current thyristor valve saturated reactor according to claim 1, wherein said case includes the top cover (1) and below cover (2), they are connected together; there is polyurethane (18) and/or earthquake resistant material and/or noise absorption material in the case; these materials and/or substances fix said winding (3), iron core (6), upper cooling fins (7), lower cooling fins (8) and pipes (11).

3. A novel direct current thyristor valve saturated reactor according to claim 1, wherein said winding (3) form a track, and its inner is empty, itself likes a track pipe; may adopt epoxy resin to pouring the winding (3).

4. A novel direct current thyristor valve saturated reactor according to claim 1, wherein said winding (3) may coat insulating layer on the surface of the winding (3) and then form the track structure, and needn't the epoxy resin to pouring the winding (3); the number and thickness of said insulating layer can both be adjusted according to the insulation requirement of the insulating layer.

5. A novel direct current thyristor valve saturated reactor according to claim 1, wherein the couple number of said iron core (6) and the thickness of said air matting (13) can be adjusted according to the actual parameters of the reactor.

6. A novel direct current thyristor valve saturated reactor according to claim 1, wherein the number of said upper cooling fins (7) and lower cooling fins (8) can be adjusted according to the actual parameters of the reactor.

7. A novel direct current thyristor valve saturated reactor according to claims 1, wherein the shape of said winding (3) may also be orbicular, elliptical and/or other shapes which are suitable for the inner empty structure.

8. A novel direct current thyristor valve saturated reactor according to claim 1, wherein there are stainless steel faucets (9) and pipe couplings (10) on the both sides of said upper cooling fins (7) and lower cooling fins (8); the faucet (9) inside direction of the winding (3) of upper cooling fins (7) which is perpendicular to the line segment of the winding (3) connect pipes (11), and the faced lower cooling fins (8) are also connected with pipes (11).

* * * * *